US008112900B2

(12) United States Patent
Romanek

(10) Patent No.: US 8,112,900 B2
(45) Date of Patent: Feb. 14, 2012

(54) HEARING AID DRYER

(75) Inventor: Harvey Romanek, St. Petersburg, FL (US)

(73) Assignee: Hearing Technologies International, Inc., Pinellas Park, FL (US)

( * ) Notice: Subject to any disclaimer, the term of this patent is extended or adjusted under 35 U.S.C. 154(b) by 275 days.

(21) Appl. No.: 12/616,472

(22) Filed: Nov. 11, 2009

(65) Prior Publication Data

US 2010/0088922 A1 Apr. 15, 2010

Related U.S. Application Data

(63) Continuation-in-part of application No. 12/249,578, filed on Oct. 10, 2008, now Pat. No. 7,814,678.

(51) Int. Cl.
*F26B 19/00* (2006.01)
*F26B 25/06* (2006.01)
*F26B 25/00* (2006.01)

(52) U.S. Cl. ..... 34/202; 34/218; 34/233; 34/235; 34/239; 34/88; 34/275

(58) Field of Classification Search ..... 34/201, 34/202, 218, 232, 233, 235, 239, 87, 88, 34/524, 526, 534, 543, 546, 549, 553, 554, 34/562, 572, 275
See application file for complete search history.

(56) References Cited

U.S. PATENT DOCUMENTS

| | | | | |
|---|---|---|---|---|
| 2,223,943 | A * | 12/1940 | Miller | 362/140 |
| 5,640,783 | A | 6/1997 | Schumaier | |
| 5,852,879 | A | 12/1998 | Schumaier | |
| 6,399,920 | B1 | 6/2002 | Guinn | |
| 6,477,866 | B1 * | 11/2002 | Chamberlin et al. | 68/12.02 |
| 7,017,276 | B2 | 3/2006 | Greenspan et al. | |
| 2005/0122708 | A1 | 6/2005 | Kennedy | |
| 2008/0085224 | A1 | 4/2008 | Cheng | |

FOREIGN PATENT DOCUMENTS

| | | | |
|---|---|---|---|
| BR | 9701185 | A * | 12/1998 |
| KR | 2003092985 | A * | 12/2003 |
| KR | 20-0351774 | Y1 | 6/2004 |
| KR | 20-0387227 | Y1 | 6/2005 |
| KR | 20-0389668 | Y1 | 7/2005 |

* cited by examiner

*Primary Examiner* — Jiping Lu
(74) *Attorney, Agent, or Firm* — Larson & Larson, P.A.; Frank Liebenow; Justin Miller

(57) ABSTRACT

An application for a hearing aid drying/disinfecting system includes a closable container with an internally mounted ultraviolet lamp for disinfecting the hearing aid. A heating element creates an internal temperature that is higher than ambient temperature and a fan circulates air through vents from the outside of the container over the hearing aid and back out, thereby drying the hearing aid contained within the drying/disinfecting system. The vents are positioned to reduce ultraviolet emissions out of the container.

20 Claims, 12 Drawing Sheets

HEARING AID DRYER

RELATED APPLICATIONS

This application is a continuation-in-part of co-pending application Ser. No. 12/249,578 filed Oct. 10, 2008.

FIELD OF THE INVENTION

This invention relates to an appliance for reducing moisture damage to sensitive electronic devices and more particularly to an appliance for reducing moisture in hearing aids.

BACKGROUND

Current trends in electronics have enabled the production of hearing aids small enough to reside partially or completely in the ear canal. This exposes the devices to a warm, humid environment and presents the opportunity for damage to the device and ultimately, failure of the device.

There are several ways for hearing aid wearers to protect their devices from moisture damage while they are not being worn. The simplest device is a container having desiccant material inside and way to separate the device from the desiccant.

U.S. Pat. No. 5,640,783 to Schumaier, U.S. Pat. No. 5,852,879 to Schumaier and U.S. Pat. No. 7,017,276 to Greenspan, et al, describe both drying and bactericidal activity in their devices. These devices utilize a fan to circulate air internally within the unit and have a heater to assist in moisture removal. Since the air is circulated internally, a desiccant material is used to absorb moisture from the air. At some point, the desiccant material used in the above-described devices becomes saturated with moisture and needs to be either replaced with a fresh desiccant or regenerated by heating it to a high temperature. The desiccant material is regenerated by exposure to very high temperatures, usually in excess of 100 degrees Celsius.

What is needed is a de-moisturizing appliance that does not require a desiccant material to reduce moisture in a contained electronic device.

SUMMARY OF THE INVENTION

An electronic device drying and disinfecting apparatus includes an enclosure with an internal ultraviolet lamp for disinfecting the electronic device. A heating element creates an internal temperature to reduce humidity and a fan circulates air from the outside of the container through the container and back out, thereby drying the electronic device. Precautions are included to reduce emission of ultraviolet light to outside of the enclosure through gaps between the lid/base and through air vents that are fluidly interfaced to the fan.

In one embodiment, a drying system for a hearing aid is disclosed including an enclosure having a lid portion hingedly connected to a base portion with a shelf within the base portion for supporting the hearing aid. An ultraviolet lamp (e.g., a germicidal ultraviolet lamp) is housed in the lid portion such that at least some ultraviolet light emitted from the lamp is directed towards the hearing aid. A heater is within the base portion and beneath the shelf, thereby heating the hearing aid. A force air flow system circulates air from outside the drying system, over the hearing aid and out of the drying system. The force air flow system includes a fan, a fan grill, vents in the base portion directing air over the hearing aid, vents in the lid portion, directing air away from the hearing aid and exit vents in the lid portion direction air out of the drying system. A power source is electrically connected to the fan, the heater and the ultraviolet lamp through a power switch.

In another embodiment, a drying system for a hearing aid is disclosed including an enclosure having a lid portion hingedly connected to a base portion with a shelf within the base portion for supporting the hearing aid. A source of electric power is electrically interfaced to an ultraviolet lamp (e.g., a germicidal ultraviolet lamp) that is in the lid portion. At least some ultraviolet light from the ultraviolet lamp is directed towards the hearing aid. A heater is within the base portion and beneath the shelf. A fan is also within the base portion. The fan draws air into the drying system through a fan grill in the base portion, forces air through air vents in the base portion and over the hearing aid. The air flows into the lid portion through air vents in the lid portion and exits the lid portion through exit vents in the lid portion. A power source is connected to a power switch that electrically connects the fan, the ultraviolet lamp and the heater to the power source when the power switch is closed. A timer is electrically interfaced between the power source and the ultraviolet lamp and connects the power source to the ultraviolet lamp during a timer interval. An interlock switch electrically interfaces to the timer; the interlock switch mechanically interfaces between the lid portion and the base portion and disconnects the power source from the ultraviolet lamp upon detection of an open condition between the base portion and the lid portion.

In another embodiment, a drying system for a hearing aid is disclosed including an enclosure having a lid portion hingedly connected to a base portion with a shelf within the base portion for supporting the hearing aid. A source of electric power is electrically interfaced to an ultraviolet lamp (e.g., a germicidal ultraviolet lamp) that is in the lid portion. The ultraviolet lamp is directed towards the hearing aid, thereby illuminating the hearing aid with ultraviolet light when power from the electric power source is applied to the ultraviolet lamp. A heater is located in the base portion and beneath the shelf. A system for circulating air into the drying system, over the shelf and out of the drying system is configured to limit unwanted emission of the ultraviolet light to outside of the drying system. There is a protection circuit that electrically disconnects the power source from the ultraviolet lamp responsive to detecting an open condition between the lid portion and the base portion.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
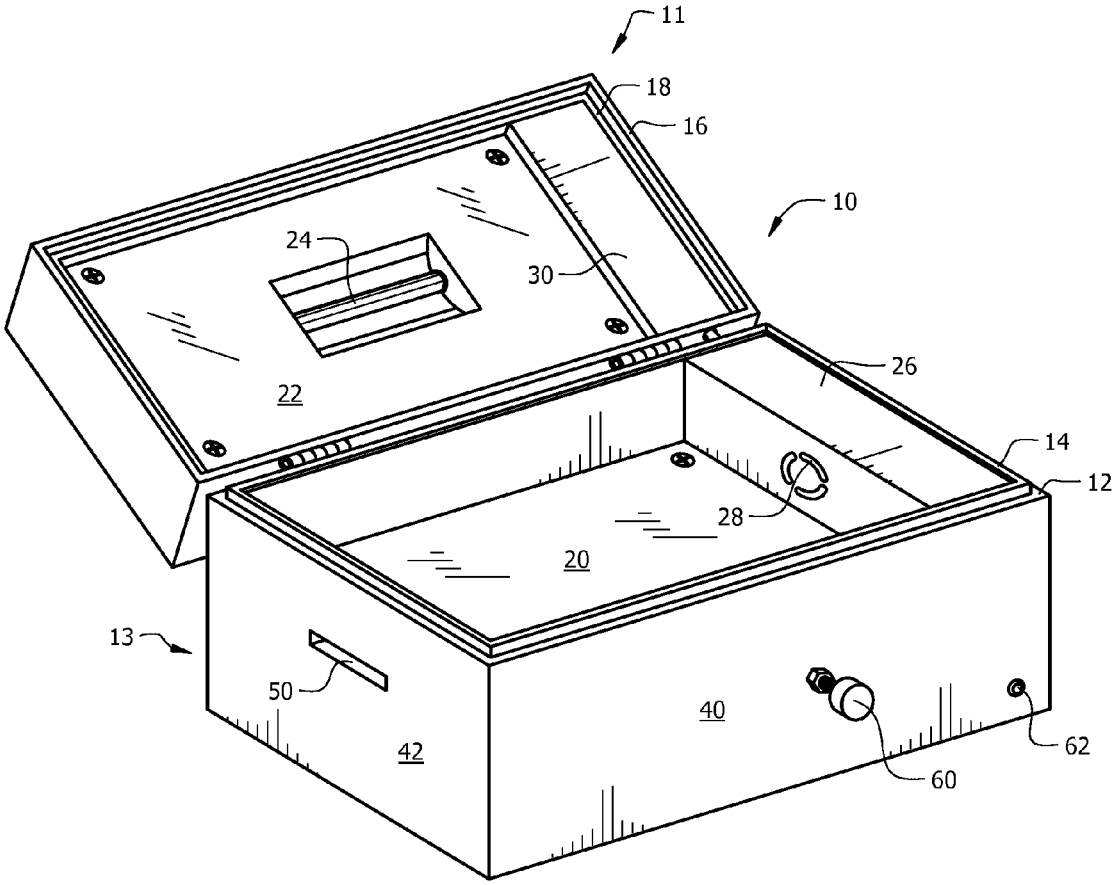
FIG. 1 illustrates a perspective view of an exemplary system of the present invention with the lid open.

Reference will now be made in detail to the presently preferred embodiments of the invention, examples of which are illustrated in the accompanying drawings. Throughout the following detailed description, the same reference numerals refer to the same elements in all figures.

Figure 2:
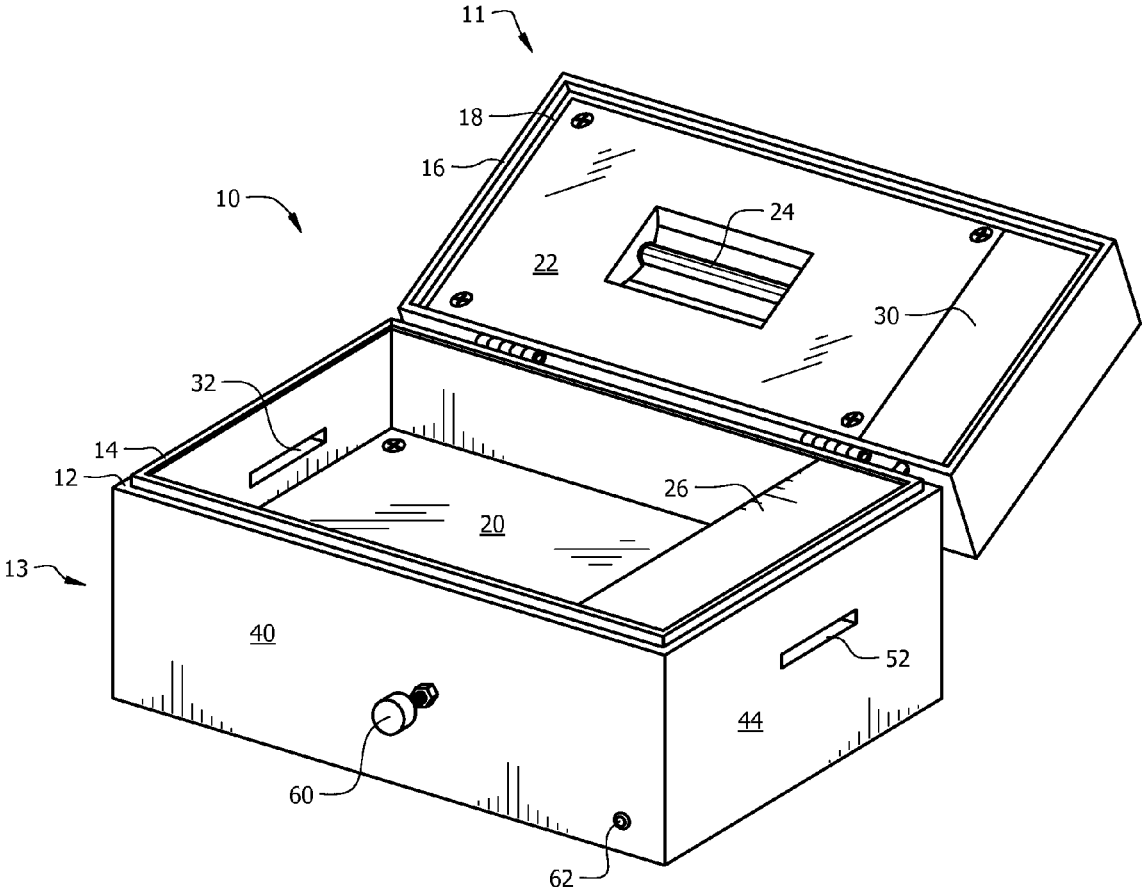
FIG. 2 illustrates a second perspective view of the exemplary system of the present invention with the lid open.

Referring to FIGS. 1 and 2, perspective views of an exemplary system 10 of the present invention with the lid open is shown. The hearing aid dryer 10 dries and disinfects a hearing aid 99 (see FIG. 6) or other electronic device using heat, a germicidal ultraviolet light and air flow without the use of a desiccant. Existing hearing aid dryers require a desiccant to remove humidity/moisture from within their sealed enclosure. The hearing aid dryer 10 performs its function without the use of a desiccant.

The hearing aid dryer 10 has a base portion 13 with a lid portion 11 hingedly attached to the base 13. The lid 11 contains an ultraviolet lamp 24 such as germicidal ultraviolet lamps as known in the industry. The ultraviolet lamp 24 emits ultraviolet light onto the hearing aid 99 (see FIG. 6) as it sits on a shelf 20, thereby disinfecting the hearing aid 99. In the preferred embodiment, the shelf 20 has a mirrored surface facing upward and the upper shelf 22 of the lid 11 has a mirrored surface facing downward to both intensify the ultraviolet light from the ultraviolet lamp 24 and to provide ultraviolet light at many different angles to reach within openings of the hearing aid 99.

A fan 81 (see FIG. 3) is positioned beneath a ledge cover 26 of the base 13. The fan 81 vents air through a fan grill 28 and in or out a vent hole 52. Although the system 10 works well with the fan 81 blowing either in either direction; it is preferred that the fan 81 blow air out through the vent hole 52 to exhaust humidity. In the preferred embodiment, air flows in through a vent hole 50 on the side 42 of the base 13 and flows out of the vent hole 52 on the opposite side 44. In another embodiment, air flows in through a vent hole 52 on the side 44 of the base 13 and air flows out of the vent hole 50 on the opposite side 42. Although it is preferred that the vent holes 50/52 as shown (on opposite side surfaces 42/44), in alternate embodiments, the vent holes 50/52 are on other surfaces. Although two vent holes 50/52 are shown, any number of vent holes 50/52 are anticipated in any shape and size.

The vent hole 50 is coupled to an internal vent hole 32 through a channel within the side 42 such to provide protection from ultraviolet light escaping, being that ultraviolet light is harmful to one's eyes. A similar channel couples vent hole 52 to another internal vent hole 33 (see FIG. 3).

Although the internal vent holes 32/33 and the external vent holes 50/52 are fabricated in any way currently known, a preferred method of staggering the internal vent holes 32/33 from the external vent holes 50/52 is by using an inner base 14 and an outer base 12. The internal vent holes 32/33 are cut or formed in the inner base 14 and external vent holes 50/52 are cut or formed in the outer base 12. Likewise, although the lid 11 is anticipated to be made in any way known in the industry, it is preferred that the lid be made of an inner lid 18 and an outer lid 16. To reduce emissions of ultraviolet light, the inner lid 18 is recessed from the outer lid 16 and the inner base 14 extends beyond the edge of the outer base 12, thereby providing a staggered interface to each other to seal the lid portion 11 to the base portion 13, thereby reducing ultraviolet light emissions outside of the system 10.

In some embodiments, an on/off switch 60 and an indicator 62 are provided on an outside surface such as the front surface 40. In some embodiments, a lid deck 30 covers part of the interlock switch (see FIG. 3).

Figure 3:
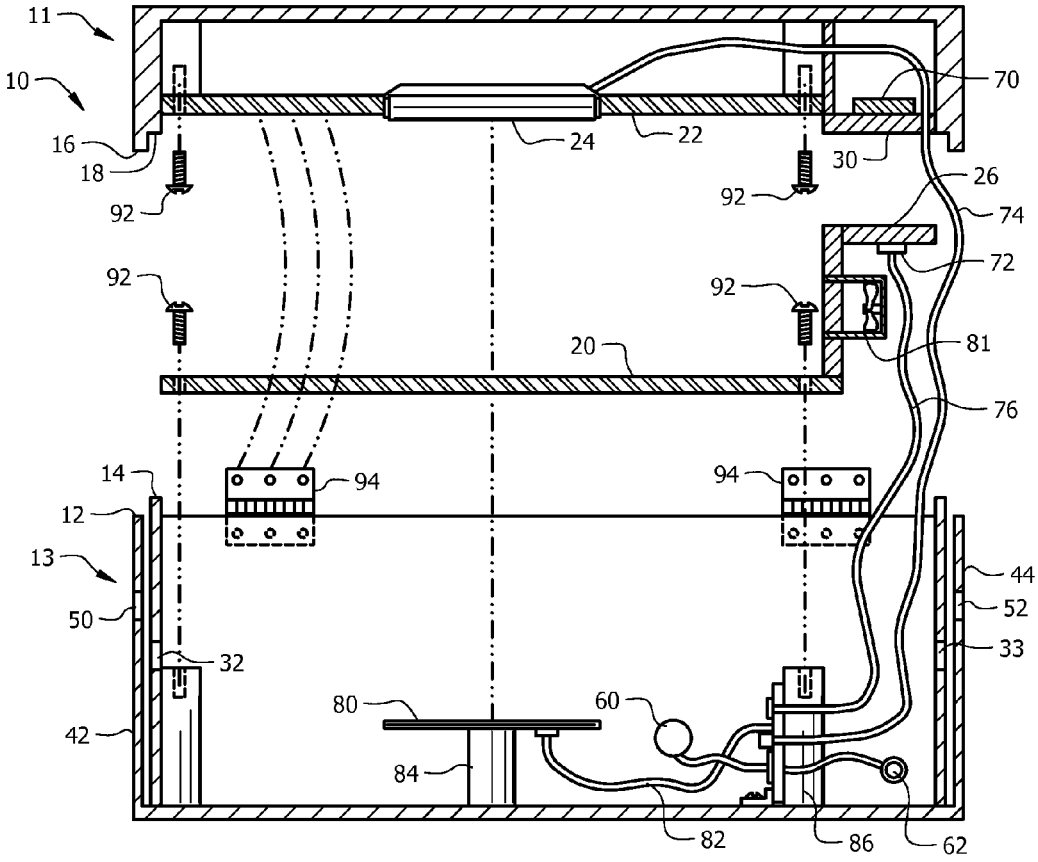
FIG. 3 illustrates a cutaway view of the exemplary system of the present invention.

Referring to FIG. 3, a plan view of the exemplary system of the present invention is shown. The hearing aid dryer 10 has a base portion 13 with a lid portion 11 attached to the base 13 by, for example, hinges 94. The lid 11 contains an ultraviolet lamp 24 that shines ultraviolet light to disinfect the hearing aid 99 (see FIG. 6) as it sits on a shelf 20. In the preferred embodiment, the shelf 20 has a mirrored surface facing upward and the upper shelf 22 of the lid 11 has a mirrored surface facing downward to both intensify the ultraviolet light from the ultraviolet lamp 24 and to provide ultraviolet light at many different angles to reach within openings of the hearing aid 99. The shelf 20 and upper shelf 22 are fastened to the lid 11 and base 13 with screws 92 or are affixed in any other way known.

A fan 81 is positioned beneath the ledge cover 26 of the base 13. The fan 81 blows air through a fan grill 28 (see FIGS. 1 and 2) and in or out a vent holes 52/33. In the preferred embodiment, air flows in through vent holes 50/32 on the side 42 of the base 13 and flows out of the vent hole 52/33 on the opposite side 44. In another embodiment, air flows in through a vent hole 52/33 on the side 44 of the base 13 and air flows out of the vent hole 50/32 on the opposite side 42. Although it is preferred that the vent holes 50/52 are shown on opposite side surfaces 42/44, in alternate embodiments, the vent holes 50/32/52/33 are on other surfaces. Although two vent holes 50/32/52/33 are shown, any number of vent holes 50/32/52/33 are anticipated in any shape and size.

The vent hole 50 is coupled in a staggered configuration to an internal vent hole 32 through a channel within the side 42 to provide protection from ultraviolet light escaping, being that ultraviolet light is harmful to one's eyes. In this way, since light and ultraviolet light do not naturally bend, very little ultraviolet light is emitted out of the vent hole 50 (it is possible for a harmless, very small amount of reflected ultraviolet light to escape). A similar channel couples vent hole 52 to the other internal vent hole 33.

Although the internal vent holes 32/33 and the external vent holes 50/52 are fabricated in any way currently known, a preferred method of staggering the internal vent holes 32/33 from the external vent holes 50/52 is by using an inner base 14 and an outer base 12. The internal vent holes 32/33 are cut or formed in the inner base 14 and external vent holes 50/52 are cut or formed in the outer base 12. Likewise, although the lid 11 is anticipated to be made in any way known in the industry, it is preferred that the lid be made of an inner lid 18 and an outer lid 16. To reduce emissions of ultraviolet light, the inner lid 18 is recessed from the outer lid 16 and the inner base 14 extends beyond the edge of the outer base 12, thereby providing a staggered pair of interface edges that seal and reduce ultraviolet light emissions.

To prevent operation of the ultraviolet light when the hearing aid dryer 10 is opened, an interlock is provided. In the example shown, the interlock comprises a magnet 70 and a magnet sensing switch 72, for example, a reed switch. The magnet sensing switch 72 is coupled to the main circuit board 86 through wires 76. When the magnet sensing switch 72 detects a reduction of magnetic field from the magnet 70 (e.g., the lid 11 is opened slightly), circuitry on the main circuit board 86 prevents the flow of electricity through wires 74 to the ultraviolet lamp 24.

In some embodiments, an on/off switch 60 and an indicator 62 are provided on an outside surface such as the front surface 40 and are connected to the main circuit board 86.

A heating element 80 is powered through wires 82 connecting it to the main circuit board 86. The heating element 80 is any known heating element such as a resistive heating element or a semiconductor heating element, etc. In some embodiments, the heating element 80 is held close to the shelf 20 by a stand-off 84.

Figure 4:
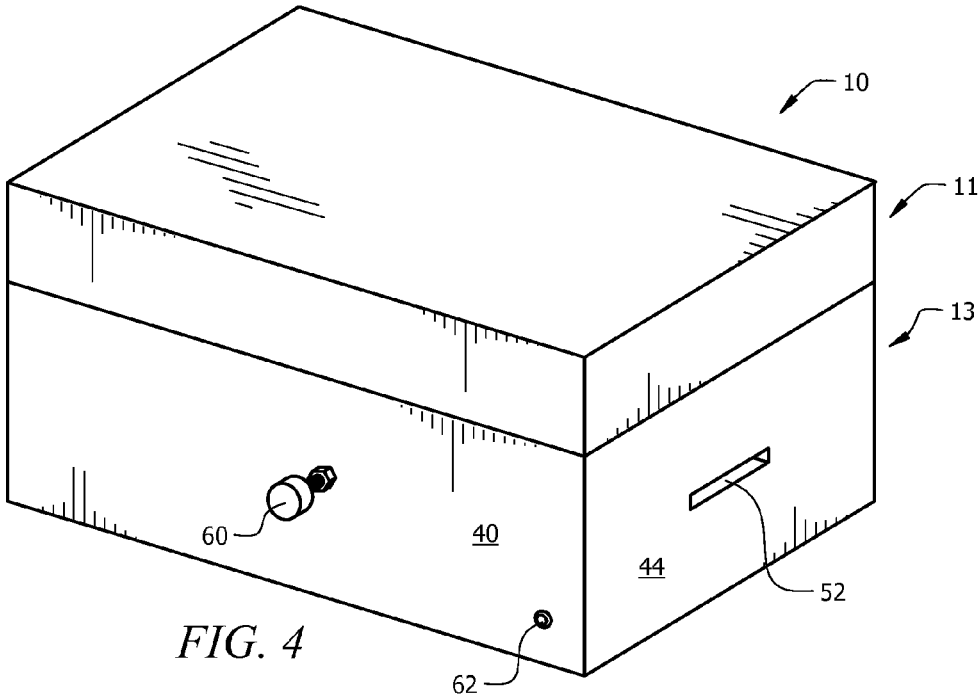
FIG. 4 illustrates a perspective view of the exemplary system of the present invention with the lid shut.

Referring to FIG. 4, a perspective view of the exemplary system of the present invention with the lid shut 11 is shown. In this view, the power switch 60 and indicator 62 are located on the front surface 40 of the base 13 and the vent hole 52 on the right side 44 of the base 11 is visible. The lid 11 is closed, thereby enabling operation of the ultraviolet lamp 24.

Figure 5:
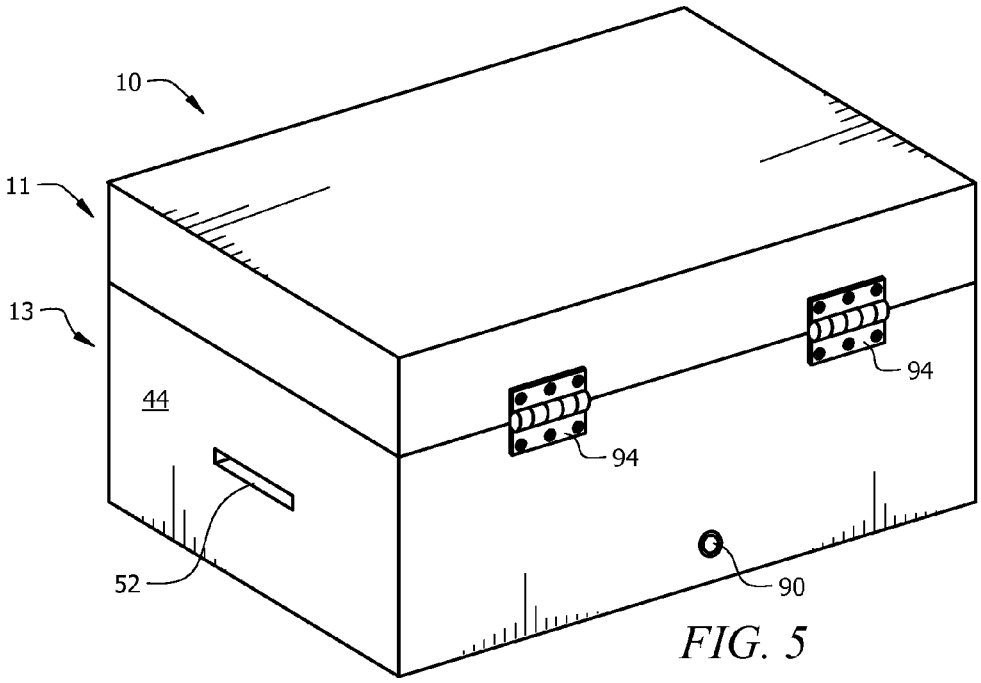
FIG. 5 illustrates a second perspective view of the exemplary system of the present invention with the lid shut.

Referring to FIG. 5, a second perspective view of the exemplary system of the present invention with the lid 11 shut is shown. In this view, a power connector 90 (e.g., a power source or source of power) is located on a rear surface of the base 13 and the vent hole 52 on the right side 44 of the base 11 is visible. The lid 11 is closed, thereby enabling operation of the ultraviolet lamp 24. In this example, the lid 11 is connected to the base 13 by two hinges 94, although, any number of hinges are anticipated.

Figure 6:
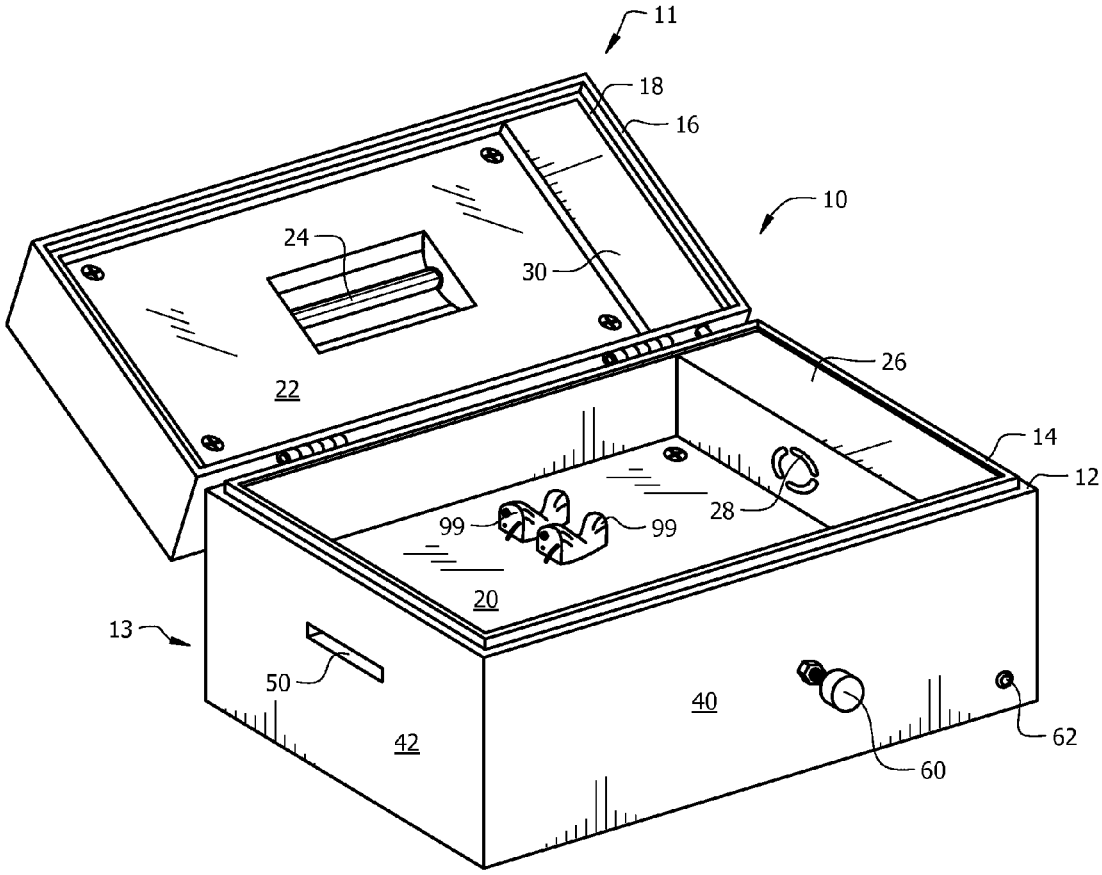
FIG. 6 illustrates a perspective view of the exemplary system of the present invention with the lid open holding a pair of hearing aids.

Referring now to FIG. 6, a perspective view of an exemplary system 10 of the present invention with the lid open holding a pair of hearing aids 99 is shown. The hearing aid(s) 99 or other electrical equipment is placed on the shelf 20 to dry and disinfect when the lid 11 is closed and the on/off switch is operated, energizing the heater 80, fan 81, and ultraviolet lamp 24.

Figure 7:
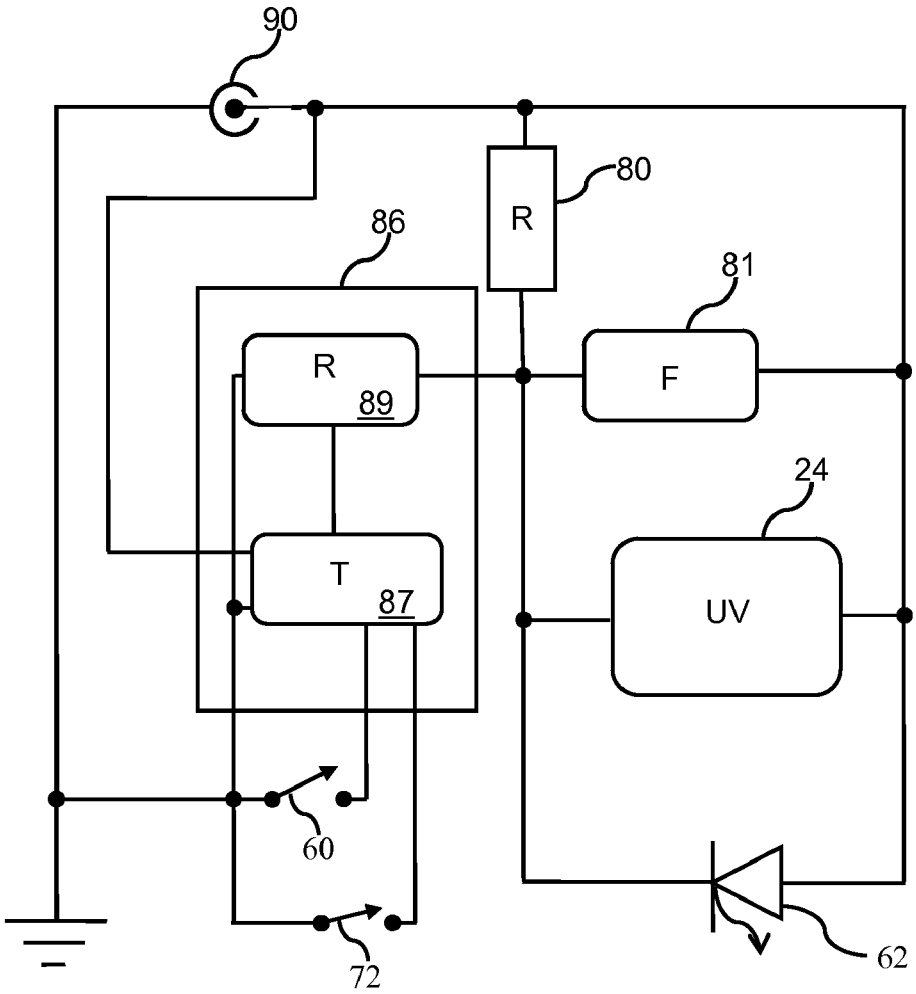
FIG. 7 illustrates a schematic view of an exemplary system of the present invention.

Referring now to FIG. 7, a schematic view of an exemplary system of the present invention will be described. Power is connected through a power jack 90 as known in the industry, one side to ground and the other is connected to the heater 80, fan 81, ultraviolet lamp 24 and indicator 62 (an LED in this example). Power and ground are also provided to a timer 87. When the power switch 60 is pressed (making contact in this example), the timer 87 starts a timing interval. During the timing interval, the timer 87 energizes a relay 89 whose contacts connect the heater 80, fan 81, ultraviolet lamp 24 and indicator 62 (the indicator is optional) to ground potential, thereby powering the heater 80 to heat, fan 81 to move air, ultraviolet lamp 24 to emit ultraviolet light and indicator 62 (optional) to illuminate. When the time interval expires, the timer de-energizes the relay 89 and removes ground potential from the heater 80, fan 81, ultraviolet lamp 24 and indicator 62, thereby turning off these devices.

Many configurations of timers 87 are anticipated. In some configurations, the fan and heater operate independent of the timer (e.g., operate when the power switch 60 is closed) and the ultraviolet lamp 24 is controlled by the timer 87 to operate the ultraviolet lamp 24 for a specific interval such as 5-7 minutes. In another exemplary configuration, the power switch 60 enables the timer 87 and the timer 87 has two intervals, one in hours (e.g., 3-4 hours) to power the fan 81 and heater 80; and another interval in minutes to power the ultraviolet lamp 24 (e.g., 5-7 minutes).

The timer is also connected to the interlock switch 72 which is closed when the lid 11 is shut. If the lid 11 is opened during the timing interval (e.g., the ultraviolet lamp 24 is on), the interlock switch 72 opens (in this example) and signals the timer to cancel the timing interval and, therefore, the timer de-energizes the relay 89 and removes ground potential from the heater 80, fan 81, ultraviolet lamp 24 and indicator 62, thereby turning off these devices.

The timing interval is either pre-set to an optimal amount of time, that required to dry and disinfect most hearing aids or is adjustable (not shown) as known in the industry.

There are many timers known in the industry including electro-mechanical timers (bi-metalic, etc.), clock-movement timers and semiconductor timers, along with many circuit configurations to achieve the same operational results; all are anticipated here within. An exemplary timer is an industry standard 555 timer that is well known. In some cases, the power output of such a timer is sufficient to operate the heater 80, fan 81, and ultraviolet lamp 24 without the use of the relay 89. In some exemplary systems, the relay 89 is a semiconductor relay or a power transistor or power FET, as known in the industry.

Since the air in the system 10 and, therefore, the hearing aid 99 is heated by the heating element 80 to a temperature above ambient, for example, 103C, as air is circulated, moisture is removed from the hearing aid 99 and exhausted from the system 10 through the vents 52/33 while fresh, drier air enters the system through the vents 50/32.

Figure 8:
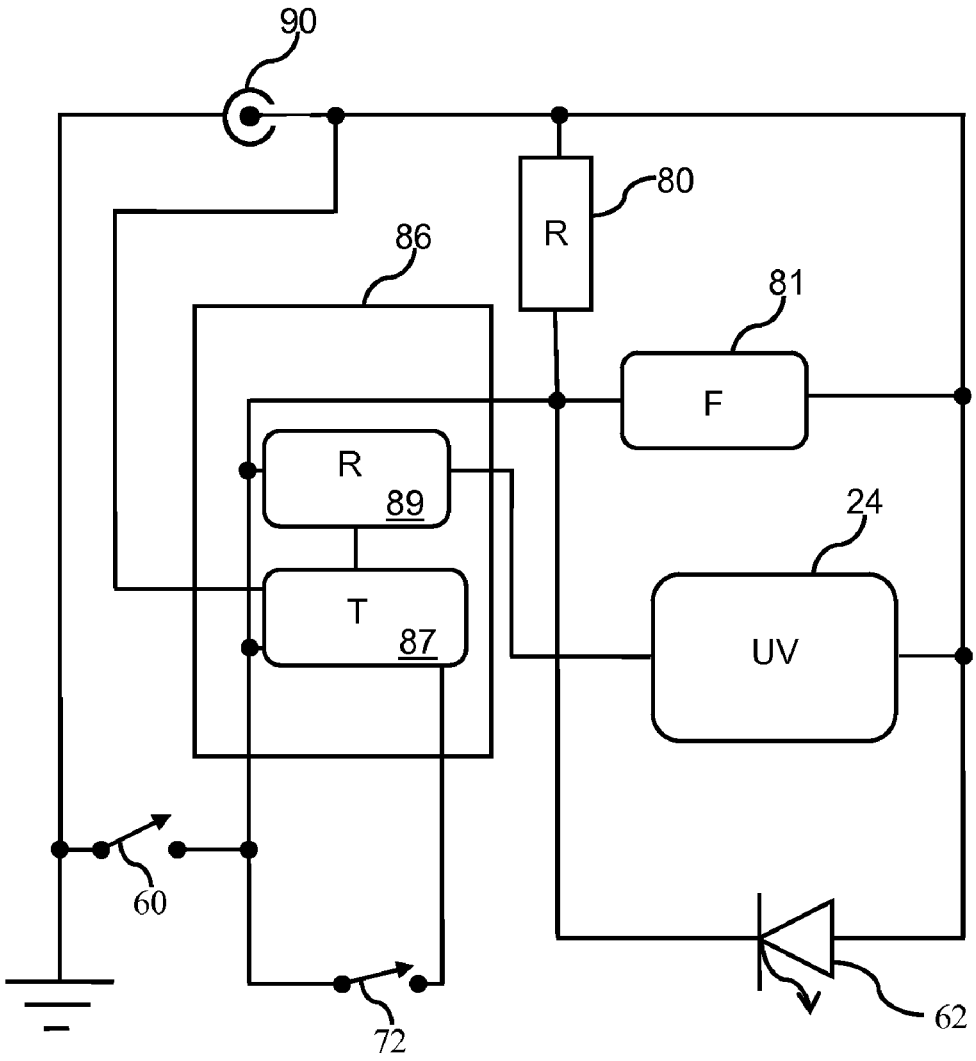
FIG. 8 illustrates a schematic view of a second exemplary system of the present invention.

Referring now to FIG. 8, a schematic view of a second exemplary system of the present invention will be described. In this embodiment, the power switch 60 connects/disconnects power to the entire system such that, when powered, the fan 81, heater 80 and indicator 62 (if provided) are energized whenever the power switch 60 is closed. Also, in this embodiment, the timer 87 is connected to the interlock switch 72 such that the timer 87 starts timing each time the lid 11 is closed or the power switch 60 is turned on (closed). For example, when the lid 11 is closed, the ultraviolet lamp 24 is energized through the timer 87 and optional relay 89 for several minutes such as 5-7 minutes.

As before, Power is connected through a power jack 90 as known in the industry, one side to ground and the other is connected to the heater 80, fan 81, ultraviolet lamp 24 and the optional indicator 62 (an LED in this example). Power and ground are also provided to a timer 87. When the power switch 60 is closed, the heater 80, fan 81 and indicator 62 (the indicator is optional) are connected to ground potential and, therefore, operate. If, the lid 11 is closed, the interlock switch 72 enables the timer 87 to start a timing interval. During the timing interval, the timer 87 energizes a relay 89 whose contacts connect (or transistor conducts current), thereby powering the ultraviolet lamp 24 to emit ultraviolet light. When the time interval expires, the timer de-energizes the relay 89 and removes ground potential from the ultraviolet lamp 24, thereby turning off the ultraviolet lamp 24 and reducing the risk of exposure to the harmful effects of ultraviolet light.

The timing interval is either pre-set to an optimal amount of time, that required to dry and disinfect most hearing aids or is adjustable (not shown) as known in the industry. The timing interval is typically 5-7 minutes, although the present invention is not restricted to any particular timing interval.

There are many timers known in the industry including electro-mechanical timers (bi-metalic, etc.), clock-movement timers and semiconductor timers, along with many circuit configurations to achieve the same or similar operational results; all are anticipated here within. An exemplary timer is an industry standard 555 timer that is well known. In some cases, the power output of such a timer is sufficient to operate the ultraviolet lamp 24 without the use of the relay 89. In some exemplary systems, the relay 89 is a semiconductor relay or a power transistor or power FET, as known in the industry.

Since the air in the system 10 and, therefore, the hearing aid 99 is heated by the heating element 80 to a temperature above ambient, for example, 105C, as air is circulated, moisture is removed from the hearing aid 99 and exhausted from the system 10 through the vents 52/33 while fresh, drier air enters the system through the vents 50/32.

Figure 9:
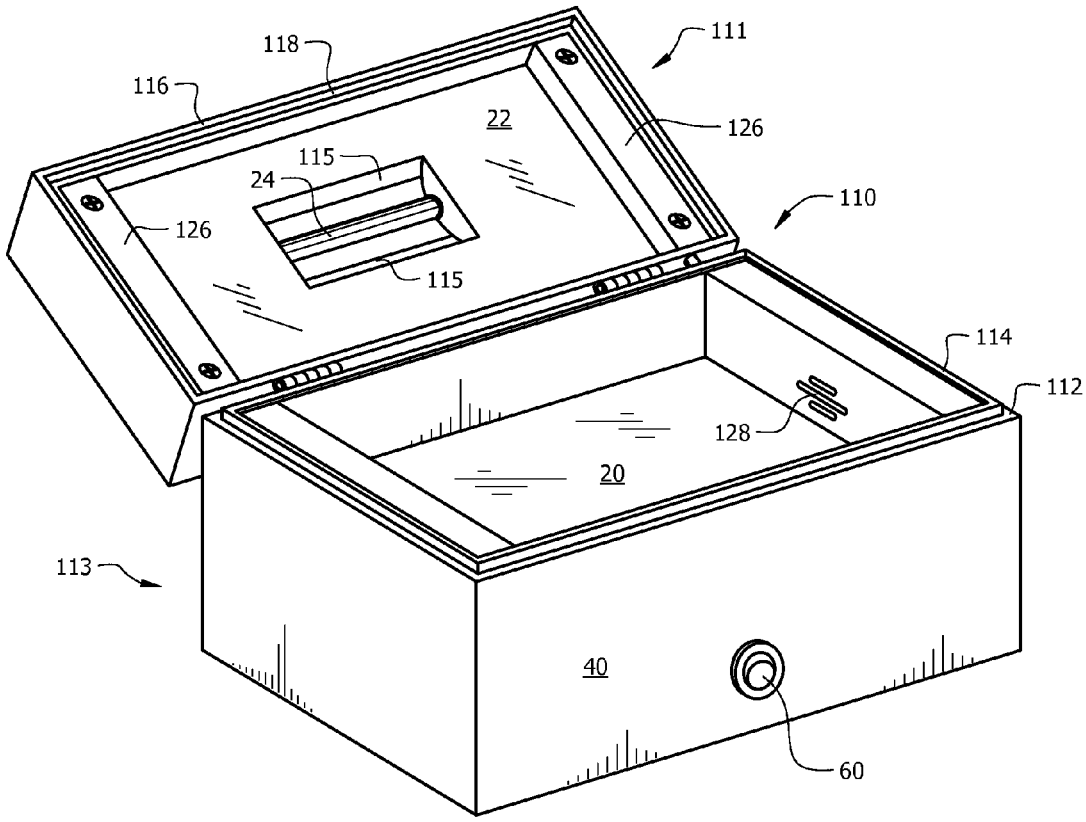
FIG. 9 illustrates a perspective view of a second exemplary system of the present invention with the lid open.
Figure 10:
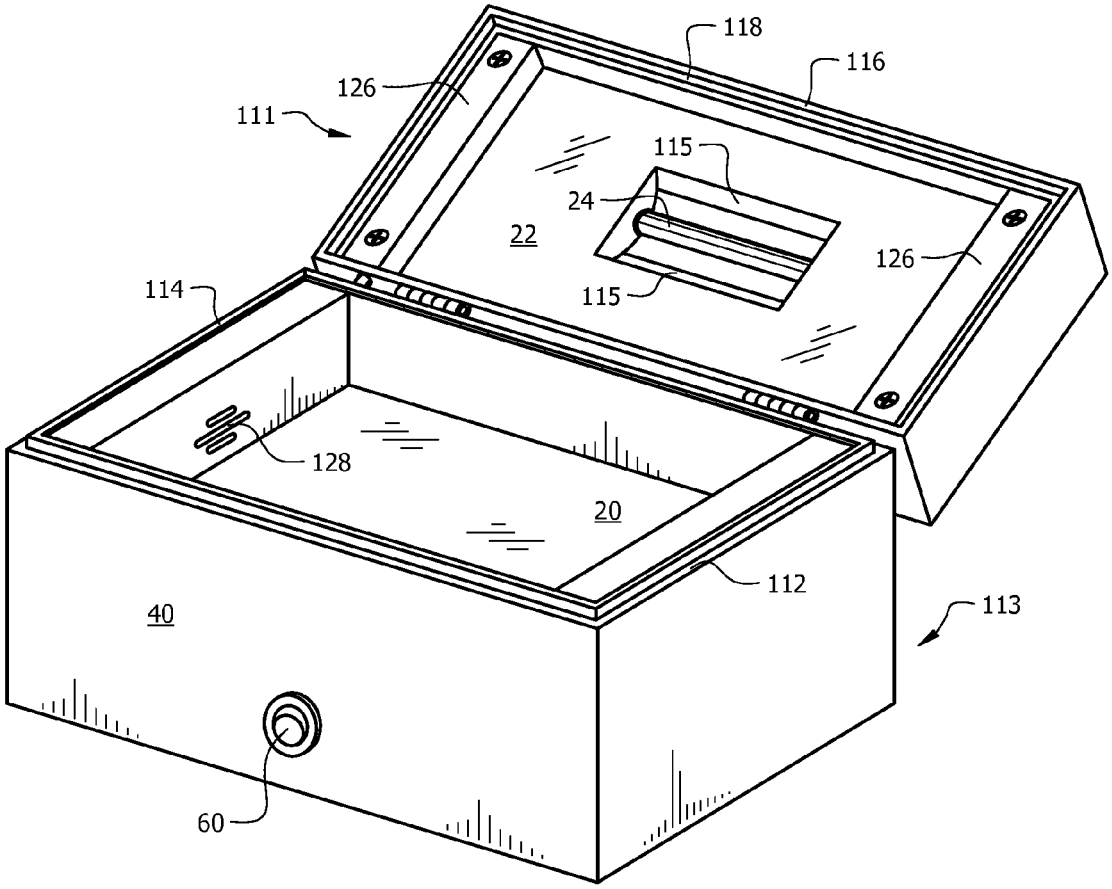
FIG. 10 illustrates a second perspective view of the second exemplary system of the present invention with the lid open.

Referring to FIGS. 9 and 10, perspective views of a second exemplary system 110 of the present invention with the lid open is shown. The hearing aid dryer 110 dries and disinfects a hearing aid 99 (see FIG. 15) or other electronic device using heat, a germicidal ultraviolet light and air flow without the use of a desiccant. The hearing aid dryer 110 has a base portion 113 with a lid portion 111 hingedly attached to the base 113. The lid 111 contains an ultraviolet lamp 24 such as germicidal ultraviolet lamps as known in the industry. The ultraviolet lamp 24 emits ultraviolet light onto the hearing aid 99 (see FIG. 15) as it sits on a shelf 20. In the preferred embodiment, the shelf 20 has a mirrored surface facing upward and the upper shelf 22 of the lid 111 has a mirrored surface facing downward to both intensify the ultraviolet light from the ultraviolet lamp 24 and to provide ultraviolet light at many different angles to reach within openings of the hearing aid 99. In some embodiments, all interior surfaces around the hearing aid 99 are mirrored. For example, inside surfaces of the lid 111 and base 113 are painted, electroplated or coated with a reflective material that reflects the ultraviolet light from the ultraviolet lamp 24 onto as many surfaces of the hearing aid 99 as possible.

A forced air system of the exemplary system 110 includes a fan 186 (see FIG. 11) that is positioned, for example, beneath the shelf 20 within the base 113. The fan 186 vents air in through a fan grill 150 (see FIG. 11) and out of the base 113 through vent holes 128, thereby creating a circulation of air around the hearing aid 99. Although the system 110 works well with the fan 186 blowing either in either direction; it is preferred that the fan 186 blow air in from the fan grill 150. In the preferred embodiment, air flows in through the fan grill 150, flows out of the base 113 through vents 128, circulates around the hearing aid 99, passes through gaps/vents 115 around the ultraviolet lamp 24 and ultimately exits through exit holes 152 in the lid 111 (see FIG. 13). Any number, size, shape and/or arrangement of holes in the fan grill 150, vents 128, gaps 115 and exit holes 152 are anticipated.

The fan grill 150 is preferably not in direct alignment with the vents 128 to reduce ultraviolet light escaping out of the fan grill 150. Likewise, the exit holes 152 are internally blocked and/or positioned to also reduce ultraviolet light escaping out of the exit holes 152. In general, concentrations of ultraviolet light are harmful to one's eyes, although a small amount of leakage is acceptable.

Additionally, it is preferred that the area where the lid 111 meets the base 113 when the system 110 is closed has a stepped set of mating edges 116/118/112/114 such that the stepped edges 116/118 of the lid 111 overlap with the stepped edges 112/114 of the base 113, also reducing leakage of ultraviolet light. Any formation of steps is anticipated to block/reduce the escape of ultraviolet light. This is accomplished through any known production method including, but not limited to, molding and/or inserts.

In some embodiments, an on/off switch 60 is provided on an outside surface such as the front surface 40. In some embodiments, a lid deck 126 houses part of the interlock switch 72.

Figure 11:
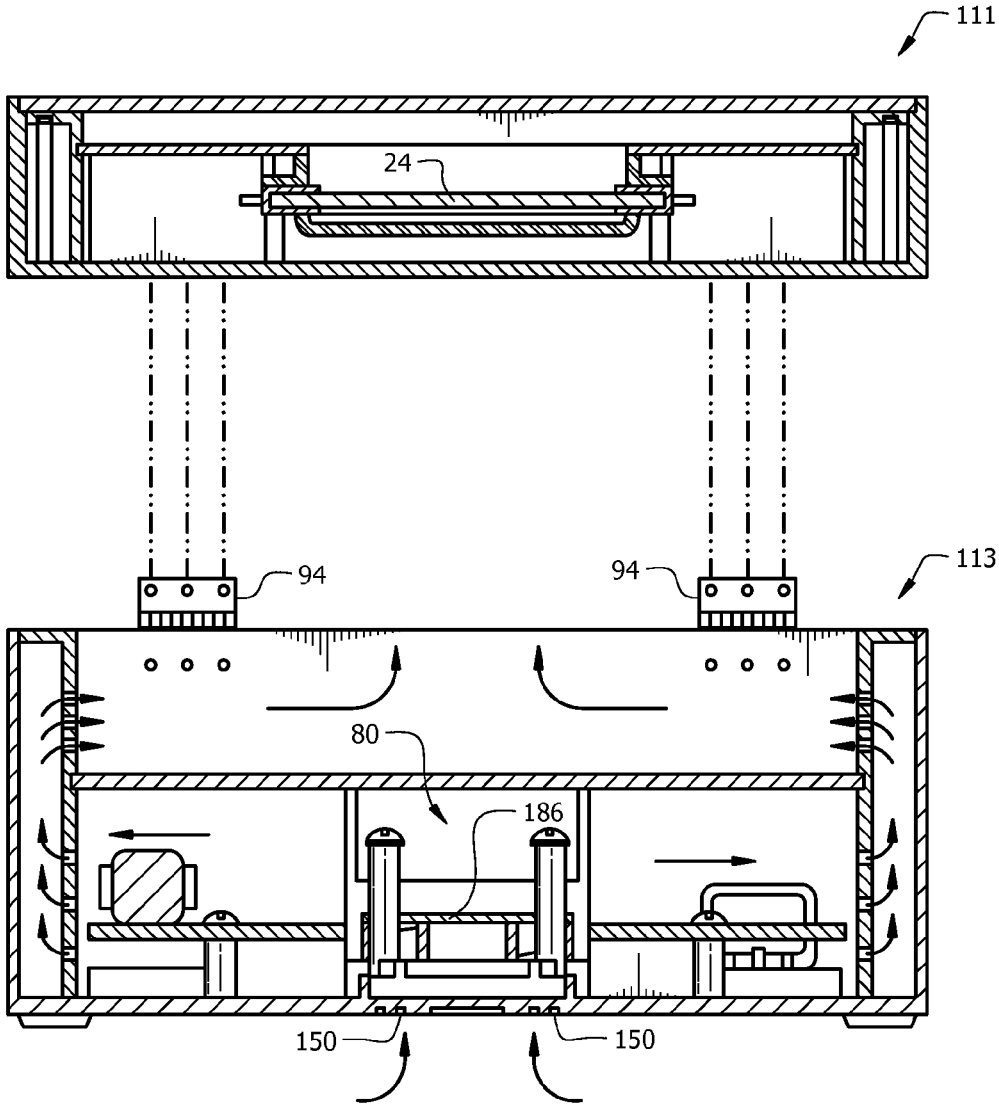
FIG. 11 illustrates a cutaway view along lines 11-11 of the second exemplary system of the present invention.

Referring to FIG. 11, a plan view of the second exemplary system of the present invention is shown. The hearing aid dryer 110 has a base portion 113 with a lid portion 111 attached to the base 113 by, for example, hinges 94. The lid 111 contains an ultraviolet lamp 24 that emits ultraviolet light to disinfect the hearing aid 99 (see FIG. 15) as the hearing aid 99 sits on a shelf 20.

A fan 186 is positioned in the vicinity of the fan grill 150 of the base 13 and blows air into the system 110 through the fan grill 150 and onto the hearing aid 99 through vent holes 128. In this example, air flows into the base 113 through the fan grill 150, out of the base 113 and onto the heating aid 99 through vents 128, then exits from the area around the hearing aid 99 through openings 115 in the lid 111 and out of the lid 111 through exit holes 152.

To prevent operation of the ultraviolet light when the hearing aid dryer 110 is opened, an interlock is provided. In the example shown, the interlock comprises a magnet 70 and a magnet sensing switch 72, for example, a reed switch (see FIG. 3). The magnet sensing switch 72 prevents the flow of electricity through wires 74 to the ultraviolet lamp 24 when the lid 111 is opened slightly.

A heating element 80 provides heat to the shelf 20 to improve drying of the hearing aid 99.

Figure 12:
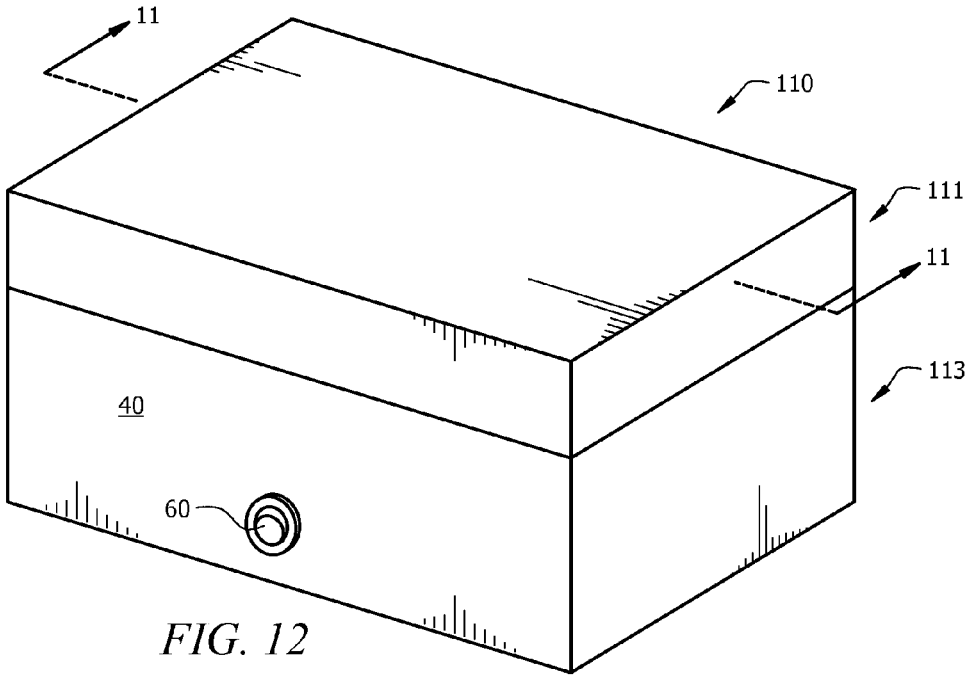
FIG. 12 illustrates a perspective view of the second exemplary system of the present invention with the lid shut.

Referring to FIG. 12, a perspective view of the second exemplary system of the present invention is shown with the lid 111 shut. In this view, the power switch 60 is located on the front surface 40 of the base 113. The lid 111 is closed, thereby enabling operation of the ultraviolet lamp 24.

Figure 13:
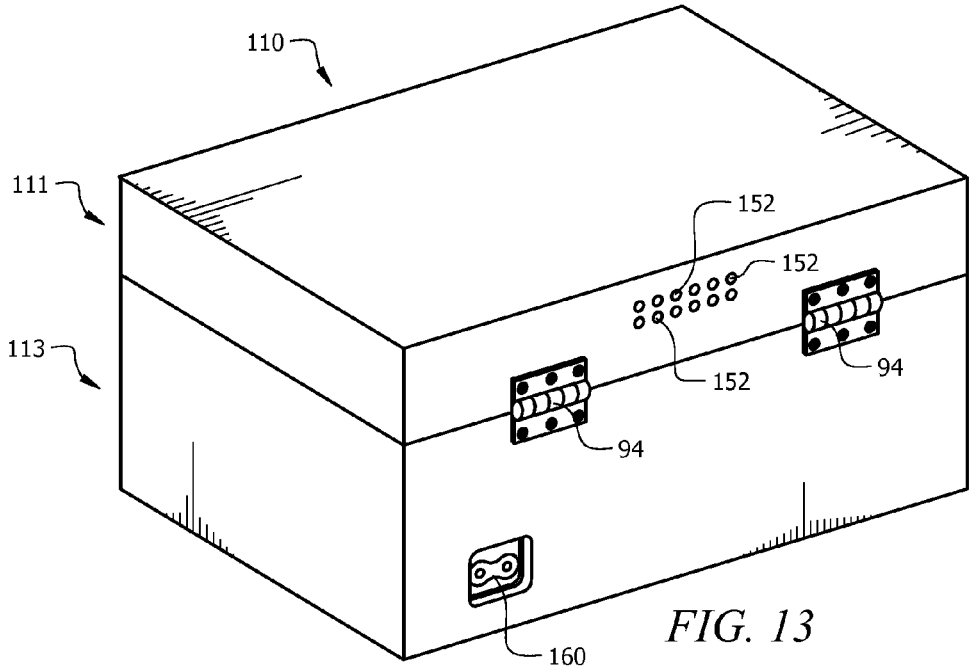
FIG. 13 illustrates a second perspective view of the second exemplary system of the present invention with the lid shut.

Referring to FIG. 13, a second perspective view of the second exemplary system of the present invention is shown from the back perspective. This view shows a power connector 160 (e.g., a power source or source of power) located on a rear surface of the base 113 and the exit holes 152 on the back surface of the lid 111. The lid 111 is closed, thereby enabling operation of the ultraviolet lamp 24. In this example, the lid 111 is connected to the base 113 by two hinges 94, although, any number of hinges or other hinge-like connections are anticipated.

Figure 14:
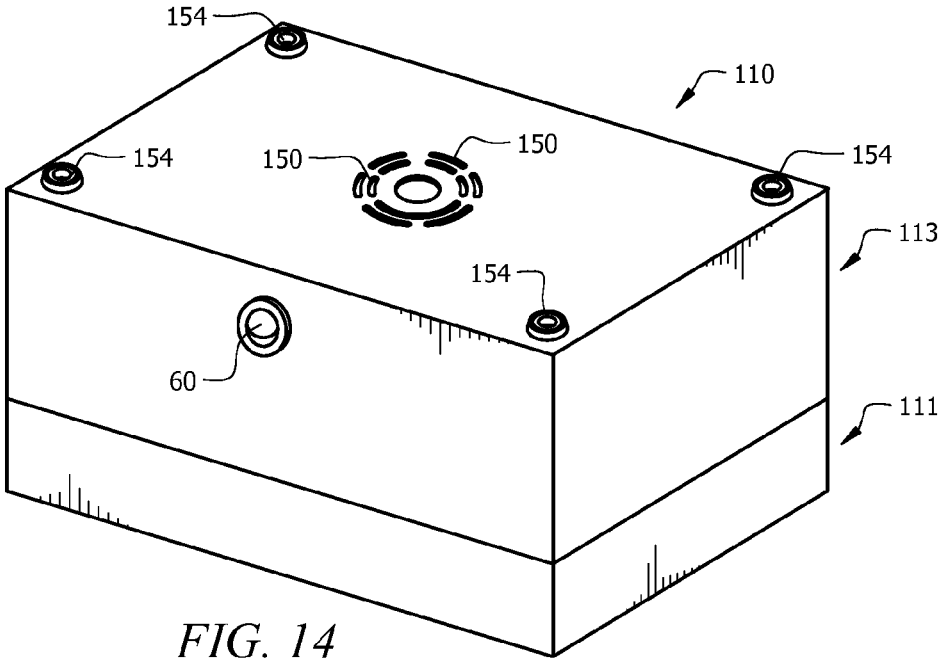
FIG. 14 illustrates a bottom perspective view of the second exemplary system of the present invention.

Referring now to FIG. 14, a perspective view of the second exemplary system 110 of the present invention is shown from the bottom perspective. In this, the bottom has the fan grill 150 for directional air flow into/out of the base 113. To improve air flow when the system 110 rests on a flat surface, feet 154 are provided to maintain a gap between the fan grill 150 and the surface.

Figure 15:
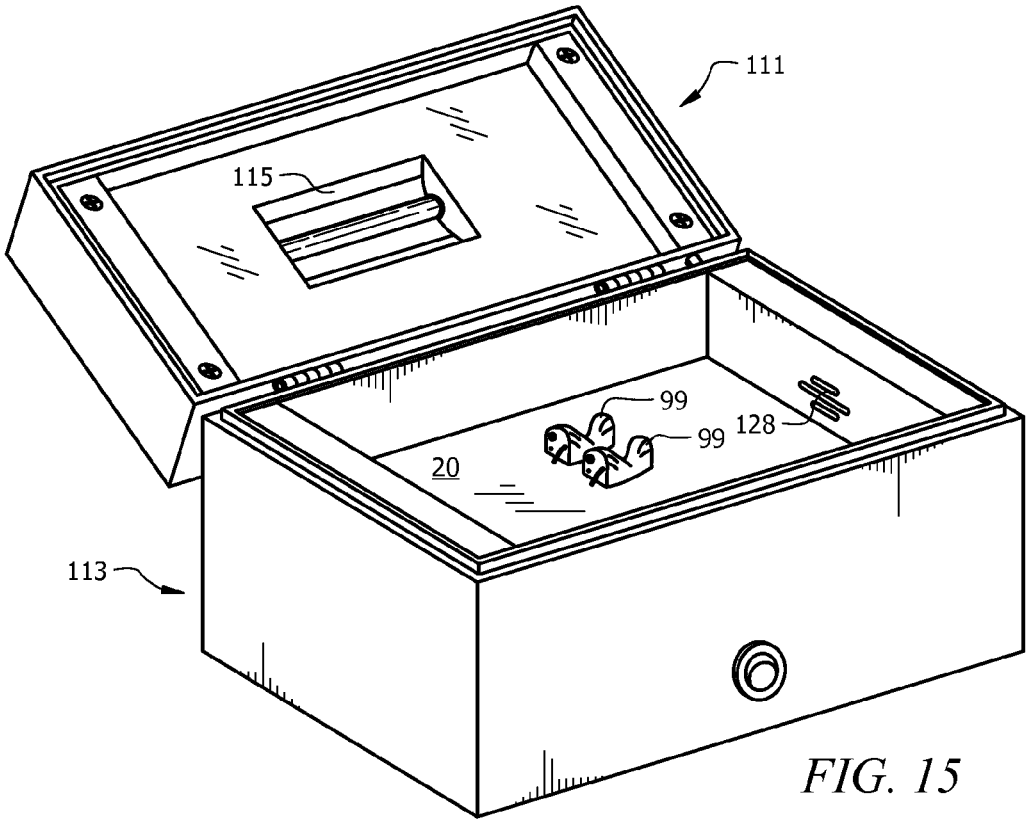
FIG. 15 illustrates a perspective view of the second exemplary system of the present invention with the lid open holding a pair of hearing aids.

Referring now to FIG. 15, a perspective view of the second exemplary system 110 of the present invention with the lid open and supporting a pair of hearing aids 99 is shown. The hearing aid(s) 99 or other electrical equipment is placed on the shelf 20 to dry and disinfect when the lid 111 is closed and the on/off switch is operated, energizing the heater 80, fan 186, and ultraviolet lamp 24. It is preferred, although not required, to have vents 128 on two sides of the base 113 to provide air flow from multiple directions. It is also preferred to have the gaps 115 (or other vent openings in the lid 111) located in proximity to where the hearing aid 99 is placed to improve air flow over the hearing aid 99.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A drying system for a hearing aid, the drying system comprising:

an enclosure, the enclosure comprising a lid portion and a base portion, the lid portion hingedly connected to the base portion;

a shelf within the base portion, the shelf supports the hearing aid;

an ultraviolet lamp in the lid portion, at least some ultraviolet light emitted from the ultraviolet lamp is directed towards the hearing aid;

a heater disposed within the base portion and beneath the shelf, the heater providing heat to the hearing aid;

a forced air flow system for circulating air from outside the drying system, the air flowing over the hearing aid, drying the hearing aid without the use of a desiccant, and the air flowing out of the drying system, the forced air flow system comprising a fan, a fan grill, vents in the base portion directing air over the hearing aid, vents in the lid portion, directing the air away from the hearing aid and exit vents in the lid portion directing the air out of the drying system, air from outside the drying system is pulled into the drying system through the fan grill by the fan, the air flows out of the vents in the base portion towards the hearing aid, through the vents in the lid portion and out of the drying system through the exit vents in the lid portion; and a power source electrically connected to the fan, the heater and the ultraviolet lamp through a power switch.

2. The drying system of claim 1, further comprising a timer interfaced between the power source and the fan, the heater and the ultraviolet lamp, the timer adapted to connect the power source to the fan, the heater and the ultraviolet lamp during a timer interval.

3. The drying system of claim 1, further comprising a timer interfaced between the power source and the ultraviolet lamp, the timer adapted to connect the power source to the ultraviolet lamp during a timer interval.

4. The drying system of claim 3, further comprising an interlock switch electrically interfaced between the power source and the timer; the interlock switch operatively coupled between the lid portion and the base portion; the interlock switch resets the timer, thereby disconnecting the power source from the ultraviolet lamp, responsive to the interlock switch detecting a separation between the lid portion and the base portion; the interlock switch starts the timer responsive to detecting a closure of the lid portion to the base portion.

5. The drying system of claim 1, further comprising an interlock switch electrically interfaced between the power source and the fan, the heater and the ultraviolet lamp; the interlock switch mechanically interfaced to the lid portion and the base portion; the interlock switch disconnects the power source from the fan, the heater and the ultraviolet lamp responsive to the interlock switch detecting a separation between the lid portion and the base portion.

6. The drying system of claim 5, wherein the interlock switch consists of a magnet disposed in the lid portion and a reed switch disposed in the base portion whereas the reed switch disconnects the power source from the fan, the heater and the ultraviolet lamp responsive to an abatement of magnetic field that occurs when the lid portion is separated from the base portion.

7. The drying system of claim 1, wherein the vents in the lid portion are gaps around the ultraviolet lamp.

8. The drying system of claim 1, wherein a top surface of the shelf is mirrored to reflect the ultraviolet light and a portion of the inside surface of the lid is mirrored to reflect the ultraviolet light.

9. The drying system of claim 1, wherein all inner surfaces around the hearing aid are mirrored to reflect the ultraviolet light.

10. A drying system for a hearing aid, the drying system comprising:

an enclosure, the enclosure comprising a lid portion and a base portion, the lid portion hingedly connected to the base portion;

a shelf within the base portion, the shelf supports the hearing aid during drying;

an ultraviolet lamp housed within the lid portion, at least some ultraviolet light from the ultraviolet lamp is directed towards the hearing aid;

a heater disposed within the base portion and beneath the shelf;

a fan disposed within the base portion, the fan drawing ambient air into the drying system through a fan grill in the base portion, the fan forcing the air through air vents in the base portion and over the hearing aid, drying the hearing aid without the use of a desiccant, the air passing through air vents in the lid portion and the air exiting the lid portion through exit vents in the lid portion;

a power source;

a power switch, the power switch electrically connects the fan, the ultraviolet lamp and the heater to the power source when the power switch is closed;

a timer electrically interfaced between the power source and the ultraviolet lamp, the timer connects the power source to the ultraviolet lamp during a timer interval; and an interlock switch, the interlock switch electrically interfaced to the timer; the interlock switch mechanically interfaced between the lid portion and the base portion; and the interlock switch disconnects the power source from the ultraviolet lamp upon detection of an open condition between the base portion and the lid portion.

11. The drying system of claim 10, wherein the interlock switch consists of a magnet disposed in the lid portion and a reed switch disposed in the base portion.

12. The drying system of claim 10, wherein a top surface of the shelf is mirrored to reflect the ultraviolet light and a portion of the inside surface of the lid is mirrored to reflect the ultraviolet light.

13. The drying system of claim 10, wherein the heater is a resistive heater.

14. The drying system of claim 10, wherein the interface where the lid portion meets the base portion is stepped, thereby reducing amounts of ultraviolet light escaping between the lid portion and the base portion.

15. A drying system for a hearing aid, the drying system consisting of:

an enclosure, the enclosure comprising a lid portion and a base portion, the lid portion hingedly connected to the base portion;

a shelf within the base portion, the shelf supporting the hearing aid;

an electric power source;

an ultraviolet lamp in the lid portion, the ultraviolet lamp directed towards the hearing aid, thereby illuminating the hearing aid with ultraviolet light when power from the electric power source is applied to the ultraviolet lamp;

a heater within the base portion and beneath the shelf;

a means for circulating air from ambient air outside of the enclosure, the means for circulating air limiting unwanted emission of the ultraviolet light to outside of the drying system, the means for circulating air drawing air into the drying system through a fan grill, through vents in the base portion toward the hearing aid, through vents in the lid portion and out of the drying system through exit vents in the lid portion; and a means for electrically disconnecting the power source from the ultraviolet lamp responsive to detecting an open condition between the lid portion and the base portion by the means for electrically disconnecting.

16. The drying system of claim 15, wherein the means for circulating air includes a fan disposed in the base portion, the fan pulling air into the base portion and blowing air towards the hearing aid.

17. The drying system of claim 16, further comprising a means for controlling the ultraviolet lamp, the heater and the fan.

18. The drying system of claim 15, wherein the means for electrically disconnecting the power source from the ultraviolet lamp consists of a magnet disposed in the lid portion and a reed switch disposed in the base portion.

19. The drying system of claim 15, wherein a top surface of the shelf is mirrored to reflect the ultraviolet light and a portion of the inside surface of the lid is mirrored to reflect the ultraviolet light.

20. The drying system of claim 15, wherein the lid portion and the base portion further comprise a means for reducing emission of the ultraviolet light from the ultraviolet lamp and through a gap between the lid portion and the base portion.

* * * * *